US007712506B2

(12) United States Patent
Huang

(10) Patent No.: US 7,712,506 B2
(45) Date of Patent: May 11, 2010

(54) TAPE DISPENSER EQUIPPED WITH EXTRA TOOL

(76) Inventor: Harrison Huang, No. 23, Lin T'So Rd., Sheng Kang Hsian, Taichung Hsien (TW) 429

( * ) Notice: Subject to any disclaimer, the term of this patent is extended or adjusted under 35 U.S.C. 154(b) by 917 days.

(21) Appl. No.: 11/515,730

(22) Filed: Sep. 6, 2006

(65) Prior Publication Data

US 2008/0053622 A1 Mar. 6, 2008

(51) Int. Cl.
*B65H 35/07* (2006.01)

(52) U.S. Cl. ..... 156/523; 156/574; 156/577; 156/579; 7/158

(58) Field of Classification Search ..... 156/523, 156/526, 574, 577, 579; 7/158, 160
See application file for complete search history.

(56) References Cited

U.S. PATENT DOCUMENTS 4,783,867 A * 11/1988 Tsao ..... 7/160
4,794,692 A * 1/1989 Wang ..... 30/123
D302,102 S * 7/1989 Amagaya ..... D8/105
6,874,189 B2 * 4/2005 Ackeret ..... 7/160
7,591,037 B1 * 9/2009 Strickland ..... 7/160
2006/0131357 A1 * 6/2006 Yu Chen ..... 225/23
2007/0261174 A1 * 11/2007 Barker ..... 7/160
2008/0098534 A1 * 5/2008 Yu Chen ..... 7/158

* cited by examiner

*Primary Examiner*—Mark A Osele
(74) *Attorney, Agent, or Firm*—Bacon & Thomas, PLLC

(57) ABSTRACT

A tape dispenser includes a handle, a base plate fixed on the handle, a tape reel pivoted on a rear of the base plate, and a seat on a front of the base plate, on a top of which a cutter is provided. The handle has a chamber therein, which is open at a bottom thereof. A holder is fixed in the chamber of the handle. A tool (utility knife) is received in the chamber of the handle and held by the holder. Therefore, the tool may be stored in the chamber of the handle and may be drawn out of the handle for operation.

7 Claims, 7 Drawing Sheets

TAPE DISPENSER EQUIPPED WITH EXTRA TOOL

BACKGROUND OF THE INVENTION

1. Field of the Invention

The present invention relates generally to a tape dispenser, and more particular to a tape equipped with extra tool for use.

2. Description of the Related Art

An earlier invention of the present inventor provides a tape dispenser equipped with a blade. The tape dispenser includes a handle, a base plate fixed on the handle, a tape reel pivoted on a rear of the base plate, and a seat on a front of the base plate, on a top of which a cutter is provided. The blade is provided on a lateral side of the seat. The blade is movable to be drawn out for cutting objects or to be retracted into the seat for storage.

Basically, the blade is fixed on the tape dispenser that user has to use the blade by operating the tape dispenser. Sometime, it causes user inconvenient.

SUMMARY OF THE INVENTION

The primary objective of the present invention is to provide a tape dispenser equipped with extra tool to be operated alone.

According to the objective of the present invention, a tape dispenser includes a handle with a chamber therein, a holder fixed in the chamber of the handle, and a tool to be received in the chamber of the handle and held by the holder. The tool may be stored in the chamber of the handle and may be drawn out of the handle for operation.

DETAILED DESCRIPTION OF THE INVENTION

Figure 1:
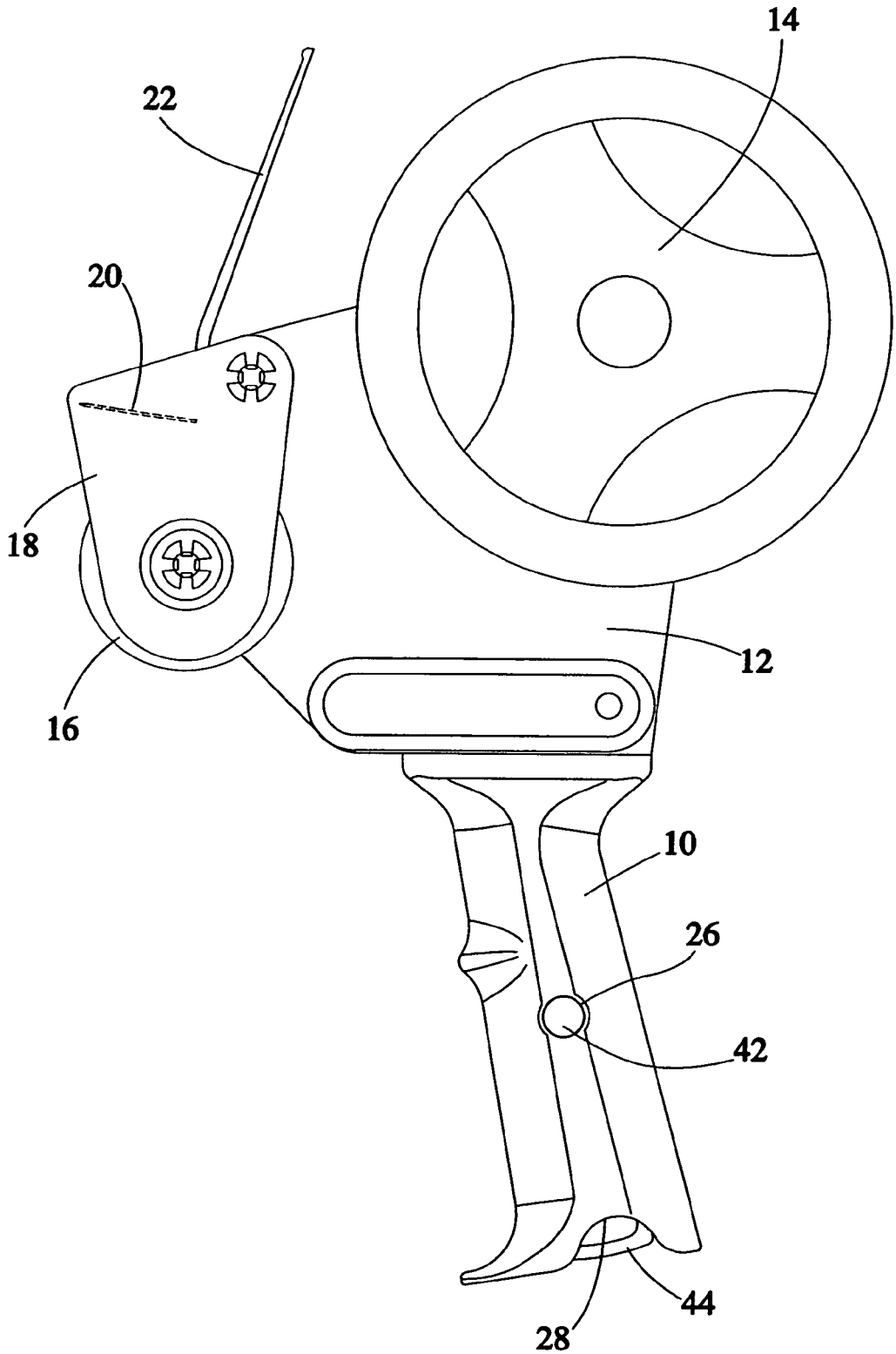
FIG. 1 is a front view of a preferred embodiment of the present invention, showing the utility knife received in the handle of the tape dispenser.

As shown in FIG. 1, a tape dispenser of the preferred embodiment of the present invention includes a handle 10 having a top and a bottom, a base plate 12 fixed on the top of the handle 10, a tape reel 14 pivoted on a rear of the base plate 12, a roller 16 and a seat 18 mounted on a front of the base plate 12. The seat 18 is provided with a cutter 20 and a plate 22.

Above elements are as same as the conventional tape dispenser, and the characters of the present invention are hereunder.

Figure 3:
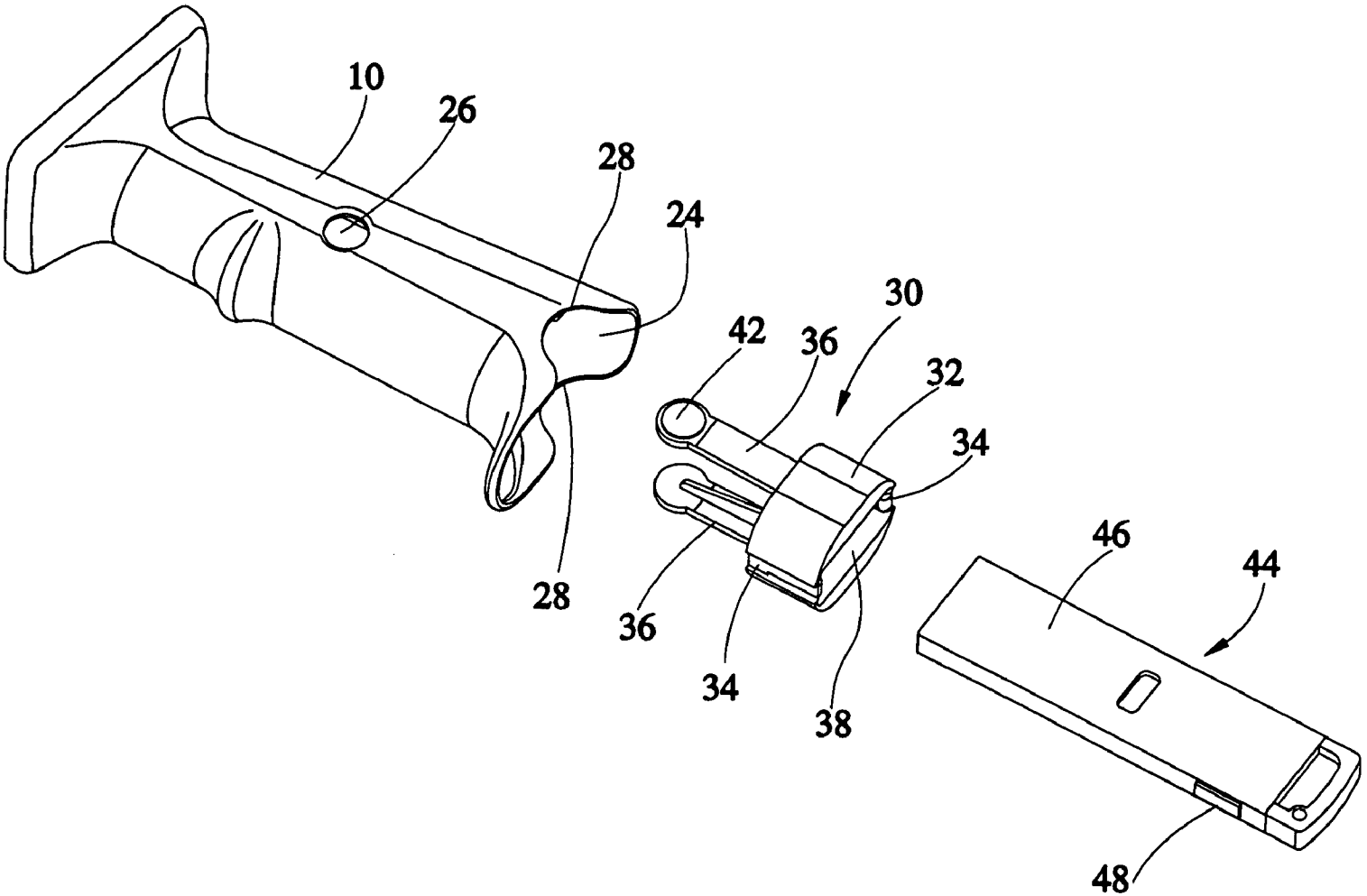
FIG. 3 is an exploded view of the handle of the preferred embodiment of the present invention.

As shown in FIG. 3, the handle 10 has a chamber 24 therein, which is open at the bottom of the handle 10, two openings 26 on a front side and a back side thereof communicated with the chamber 24 and two recesses 28 on the bottom thereof.

Figure 5:
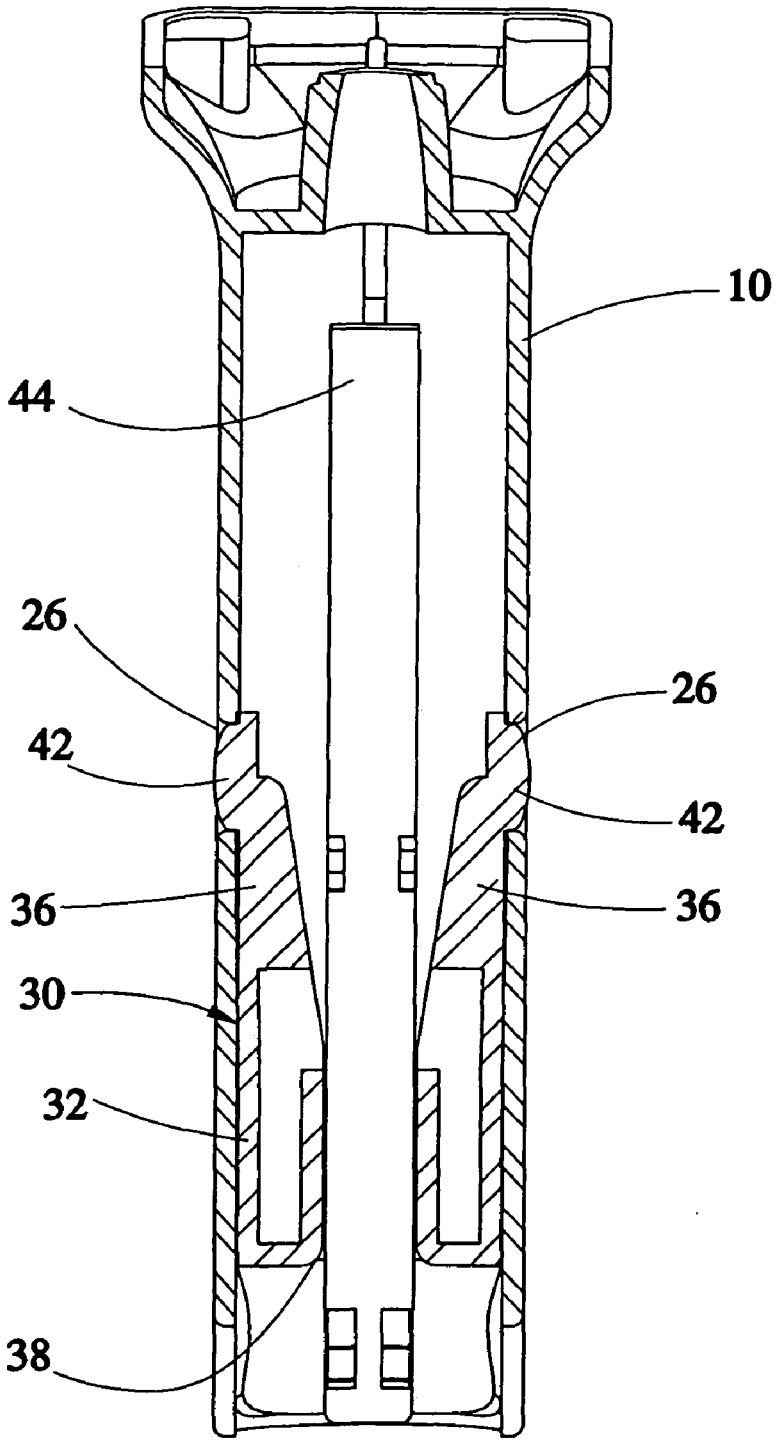
FIG. 5 is a sectional view along the 5-5 line of FIG. 4.
Figure 6:
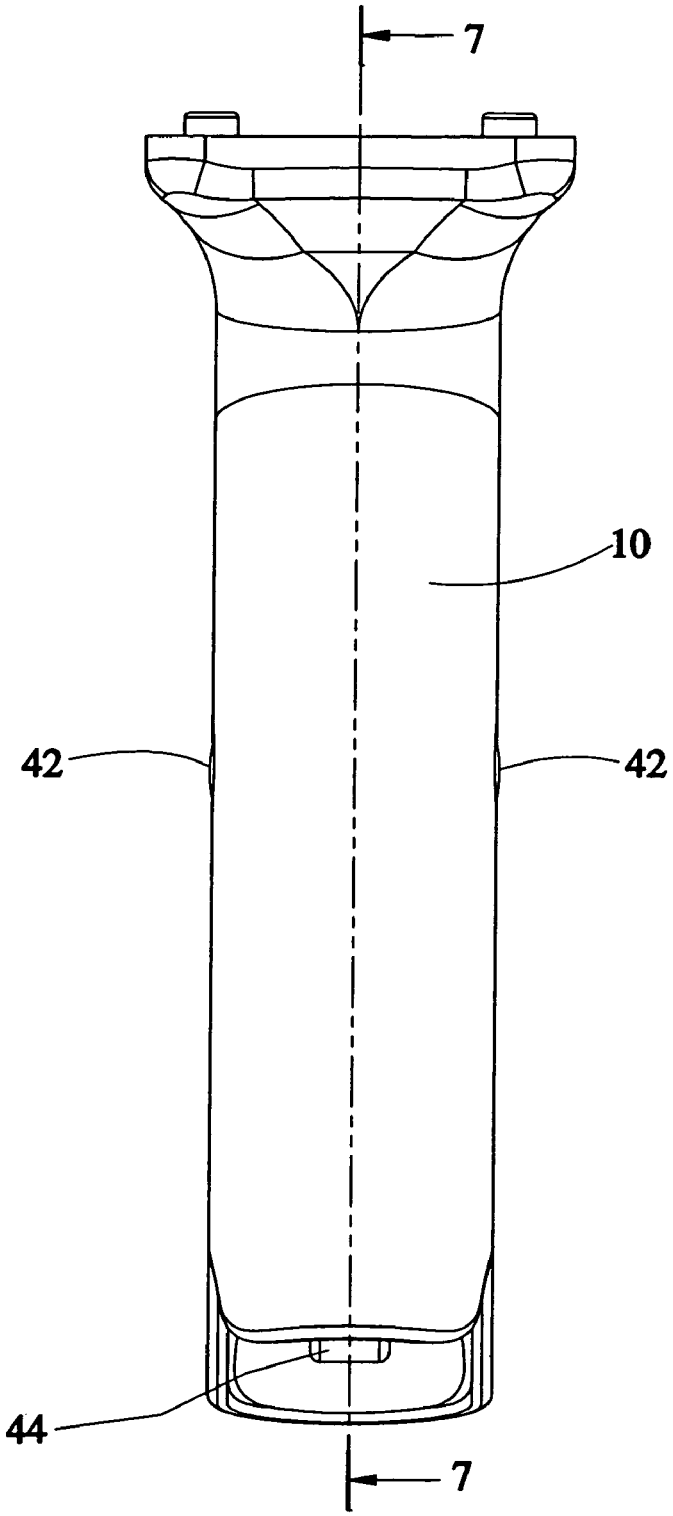
FIG. 6 is a right view of the handle of the preferred embodiment of the present invention.

A holder 30 includes a base member 32, two lock members 34 and two flexible arms 36. The base member 32 includes a tunnel 38, and the lock members 34 are located at opposite side of the tunnel 38. The lock members 34 have ends connected to base member 32 and the other ends suspended. Each of the lock members 34 has a hook 40 at the suspended end and facing the tunnel 38. The flexible arms 36 are projected from a top of the base member 32 at opposite side of the tunnel 38, each of which has a block 36 facing outwardly. The holder 30 is inserted into the chamber 24 of the handle 10 with the blocks 36 of the flexible arms 36 engaged with the openings 26 of the handle 10, as shown in FIG. 5, to fix the holder 30 in the chamber 24 of the handle 10.

Figure 2:
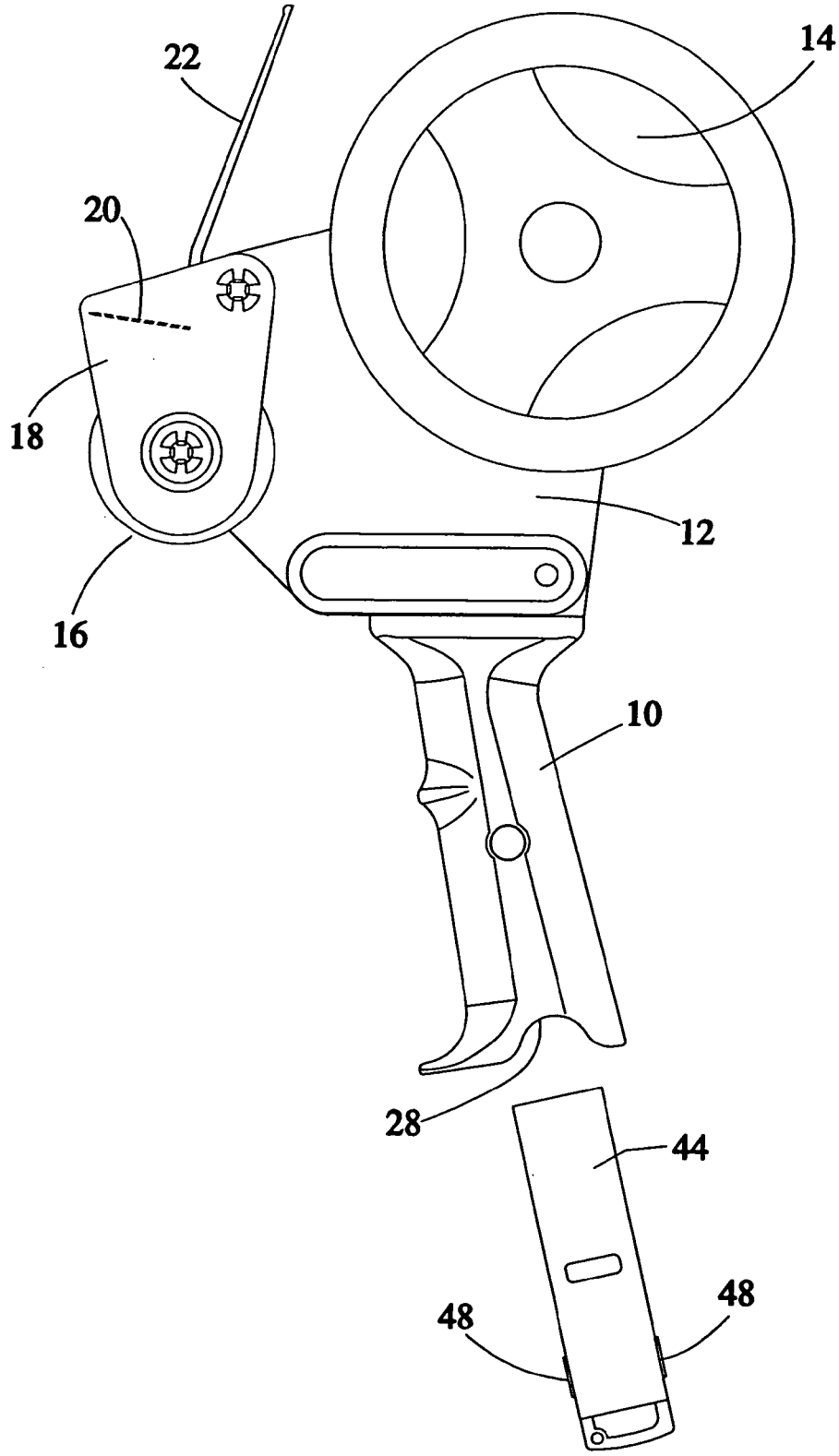
FIG. 2 is a front view of the preferred embodiment of the present invention, showing the utility knife drawn out of the handle of the tape dispenser.
Figure 4:
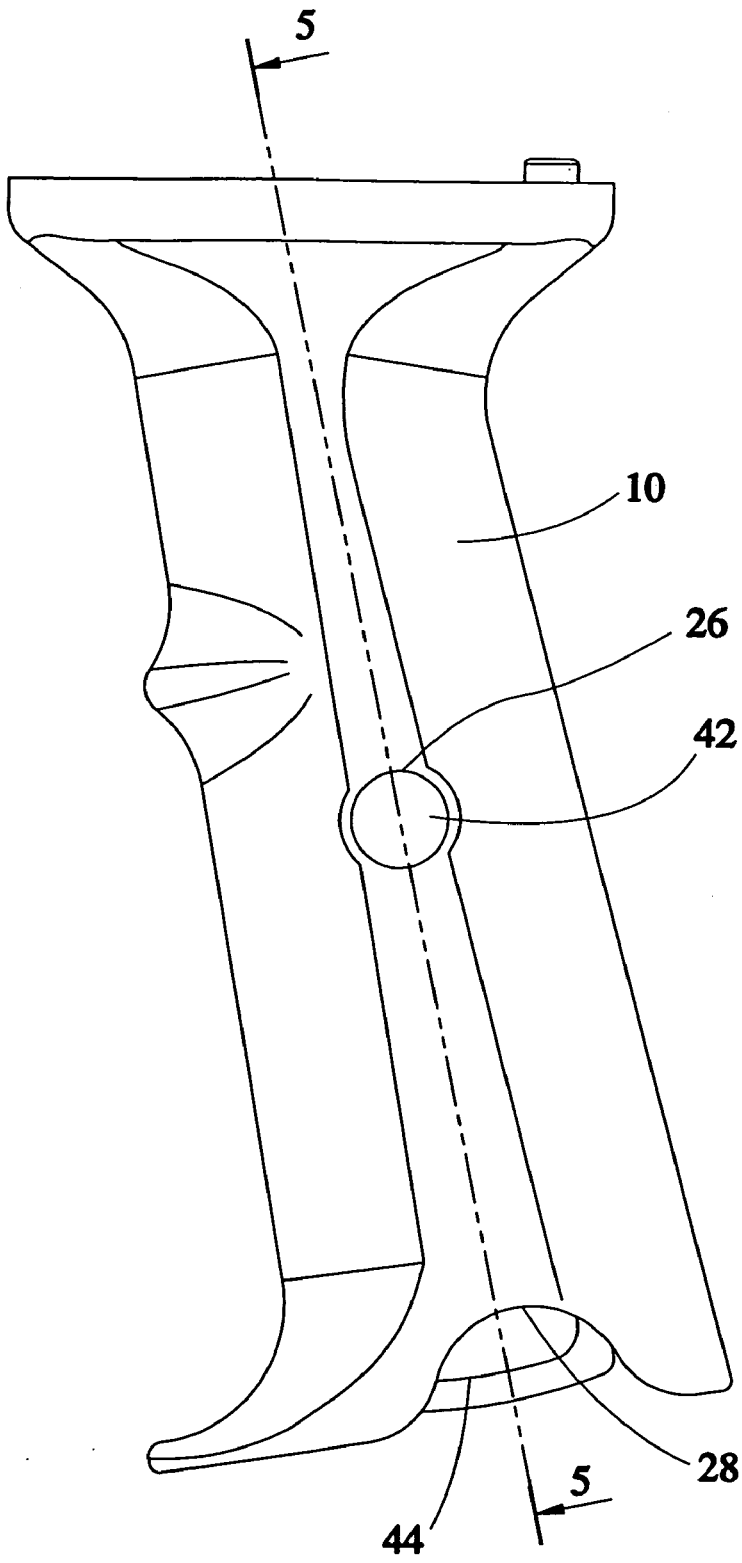
FIG. 4 is a front view of the handle of the preferred embodiment of the present invention.
Figure 7:
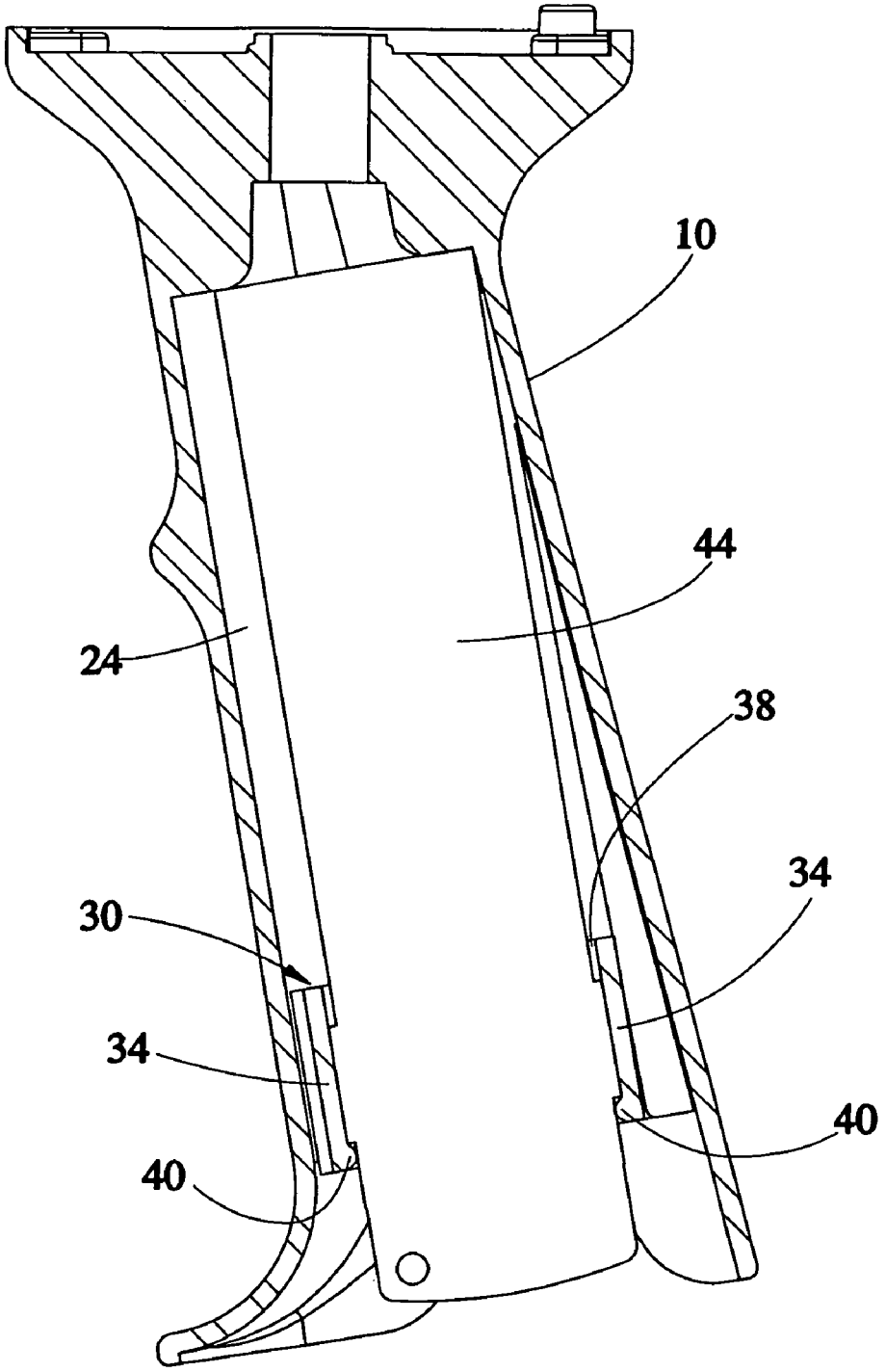
FIG. 7 is a sectional view along the 6-6 line of FIG. 6.

A tool 44, which is a conventional utility knife in the drawings, includes a housing 46 and a blade (not shown) received in the housing 46 to be drawn out. The housing 46 has two couplers 48 at lateral sides, which are blocks or apertures. The utility knife 44 may be inserted into the chamber 24 of the handle 10 and through the tunnel 38 of the holder 30 to have the hooks 40 of the lock members 34 engaged with the couplers 48 of the utility knife 44, such that the utility knife 44 is stored in the chamber 24 of the handle 10, as shown in FIG. 4 and FIG. 7. In such condition, the utility knife 44 has it bottom end exposed by the recesses 28 that user may grip the exposed part of the utility knife 44. When user grips the utility knife 44 and exerts for trying to draw the utility knife 44 out of the handle 10, the suspended ends of the lock members will be moved outwardly to disengage the hooks 40 with the couplers 48, such that the utility knife 44 may be drawn out of the handle 10 for operation alone and freely, as shown in FIG. 2)

The main scope of the present invention is that we don't change the structure of the conventional tape dispenser, and we just use the useless space in the handle to store a tool that increases the practicability of the tape dispenser much.

The holder is the device we provide to hold the tool in the chamber of the handle. In practice, it may be made on the handle directly rather than it is an independent element like the embodiment of the present invention. The present invention provides the blocks and the openings on the handle to fix the holder in the handle that makes the holder could be detachable. In practice, the holder may be just simply fixed in the handle by glue or other fastening means. The embodiment of the present invention only shows the tool as utility knife. In fact, the tool, except utility knife, may be screwdriver, wrench or other toll that may be help in the tape dispenser job. Of course, the holder should be redesigned to fit the vary tool to be stored in the handle.

What is claimed is:

1. A tape dispenser, comprising a handle with a chamber therein, wherein the chamber is open at a bottom of the handle, a holder fixed in the chamber of the handle, and a tool to be received in the chamber of the handle and held by the holder whereby the tool may be stored in the chamber of the handle and may be drawn out of the handle for operation, wherein the holder has a lock member with an end connected to the holder and an end suspended which the lock member has a hook to be engaged with a coupler of the tool.

2. The tape dispenser as defined in claim 1, wherein the handle has a recess at the bottom thereof to expose a part of the tool when it is received in the chamber.

3. The tape dispenser as defined in claim 1, wherein the coupler of the tool is a block.

4. The tape dispenser as defined in claim 1, wherein the holder has a base member with a tunnel for the tool passing through.

5. A tape dispenser, comprising a handle with a chamber therein, wherein the chamber is open at a bottom of the handle, a holder fixed in the chamber of the handle, and a tool to be received in the chamber of the handle and held by the holder whereby the tool may be stored in the chamber of the handle and may be drawn out of the handle for operation wherein the holder has a flexible arm with a block thereon, and the handle has an opening communicated with the chamber to be engaged with the block of the flexible arm.

6. The tape dispenser as defined in claim 1, wherein the holder includes a base member with a tunnel for the tool passing through and two lock members at opposite side of the tunnel to engage the tool.

7. The tape dispenser as defined in claim 1, wherein the tool is a knife.

* * * * *